United States Patent [19]

Riley

[11] Patent Number: 4,825,778

[45] Date of Patent: May 2, 1989

[54] EXTENSIBLE RAIL CAR

[75] Inventor: Joseph L. Riley, Milwaukie, Oreg.

[73] Assignees: Scott S. Corbett, Portland, Oreg.; Clinton B. Clark, Miami, Fla.

[21] Appl. No.: 96,696

[22] Filed: Sep. 15, 1987

[51] Int. Cl.[4] ..... B61D 3/00

[52] U.S. Cl. ..... 105/393; 105/418; 213/175; 213/179; 410/54; 410/58; 410/66; 410/78; 410/82; 410/90

[58] Field of Search ..... 105/393, 404, 413, 414, 105/418; 213/175, 178, 179; 410/3, 52, 54, 56, 58, 66, 77, 78, 82, 90

[56] References Cited

U.S. PATENT DOCUMENTS

| | | | |
|---|---|---|---|
| 1,429,186 | 9/1922 | Brown | 213/179 |
| 2,929,337 | 3/1960 | Romans | 105/393 |
| 3,204,579 | 9/1965 | Burns et al. | 410/54 |
| 3,207,086 | 9/1965 | Mowatt-Larssen et al. | 410/58 |
| 3,616,764 | 11/1971 | Johnson et al. | 105/414 |
| 3,812,791 | 5/1974 | Barnard | 105/393 |
| 3,924,544 | 12/1975 | Grau et al. | 410/78 |
| 4,386,880 | 6/1983 | Schimmeyer | 410/78 |
| 4,562,633 | 1/1986 | Adams et al. | 105/404 |
| 4,648,764 | 3/1987 | Pavlick | 410/82 |

*Primary Examiner*—Ronald C. Capossela
*Attorney, Agent, or Firm*—Olson and Olson

[57] ABSTRACT

A rail car is adjustable in length to accommodate the mounting thereon of cargo containers of various lengths and widths, such as the presently employed 20 foot, 40 foot, 45 foot and 48 foot lengths and 96 and 102 inch widths. Length adjustment is effected either by forming the rail car frame in two telescopic end sections, or by providing an extensible coupling tongue on one or both ends of the rail car frame. The rail car also may incorporate a collapsible fifth wheel connector for the king pin of a cargo container trailer chassis to accommodate transport of a trailer-mounted cargo container. The rail car also includes structure by which it may be manipulated by external lifting equipment to stack a plurality of the rail cars one atop another, either for stationary storage in a rail yard or for transport in a train to another location. Alternatively, a plurality of the rail cars may be lifted to a substantially vertically extending position, one adjacent another, for temporary stationary storage in a minimum of ground space.

27 Claims, 5 Drawing Sheets

EXTENSIBLE RAIL CAR

BACKGROUND OF THE INVENTION

This invention relates to railroad cars, and more particularly to a rail car that is extensible and contractible in length to accommodate the carrying of cargo containers of various lengths.

Cargo containers presently are provided in four lengths of 20 feet, 40 feet, 45 feet and 48 feet, and rail cars for supporting them are provided in lengths of 40 feet for supporting one or two 20 foot containers or a 40 foot container; 45 feet and 48 feet for supporting the 45 foot and 48 foot containers, respectively. This necessitates the maintenance of the large inventory of expensive and bulky rail cars, consuming much trackage and badly needed space when not in use. It further requires the time consuming and costly manuevering of such a variety of rail cars in the assembly of a train.

From a practical standpoint, at present moat rail cars are being built and purchased to carry 48 foot containers. However, they most often carry only two 20 foot or one 40 foot or 45 foot containers. Accordingly, the fixed 48 foot length not only creates a train length that is dangerous and annoying to the public at crossings, but it also produces excessive space between cargo containers that contributes adversely to excessive air drag or wind resistance, with consequent consumption of excessive fuel. It also presents a problem of storage of large numbers of 48 foot rail cars.

SUMMARY OF THE INVENTION

This invention provides a rail car that is capable of being adjusted in length to accommodate the support of diverse lengths of cargo containers and of semi-trailers that have cargo containers either integral therewith or detachable therefrom.

The principal objective of this invention is the provision of a rail car of the class described which overcomes the aforementioned disadvantages and limitations of prior rail cars.

Another objective of this invention is to provide a rail car of the class described which accommodates the support of two 20 foot or one 40 foot, 45 foot, or 48 foot cargo containers.

Still another objective of this invention is the provision of a rail car of the class described which is extensible and contractible in length either by adjusting the length of the rail car frame and supporting wheels, or by adjusting the length of extension of a coupling-mounting tongue at one or both ends of the rail car frame.

A further objective of this invention is to provide a rail car of the class described which accommodates the support of presently standard cargo containers of either 96 inch or 102 inch widths.

Another objective of this invention is the provision of a rail car of the class described which accommodates the support of semi-trailers which integrally or detachably mount cargo containers of various lengths and widths.

A still further objective of this invention is the provision of a rail car of the class described a plurality of which are capable of being stacked one upon another for temporary stationary storage or for transport by the bottommost rail car incorporated in a train.

A still further objective of this invention is the provision of a rail car of the class described a plurality of which are capable of being stored in a substantially vertically extending position one against another.

Another objective of this invention is the provision of a rail car of the class described which includes a novel coupler by which a plurality of said rail cars may be connected together with a minimum of space between them.

Another objective of this invention is the provision of a rail car of the class described which includes a commercially available cargo container lock that utilizes the weight of the rail car to move the lock to locking position to secure the rail car on top of an underlying rail car for storage or transport, and utilizes the weight of the underlying rail car to move the lock from locking position to releasing position to remove the top rail car.

A further objective of this invention is to provide a rail car of the class described which is of relatively simplified construction for economical manufacture, maintenance and repair.

The foregoing and other objects and advantages of this invention will appear from the following detailed description, taken in connection with the accompanying drawings of preferred embodiments.

DESCRIPTION OF THE PREFERRED EMBODIMENTS

Figures 1, 2, 3, 4:
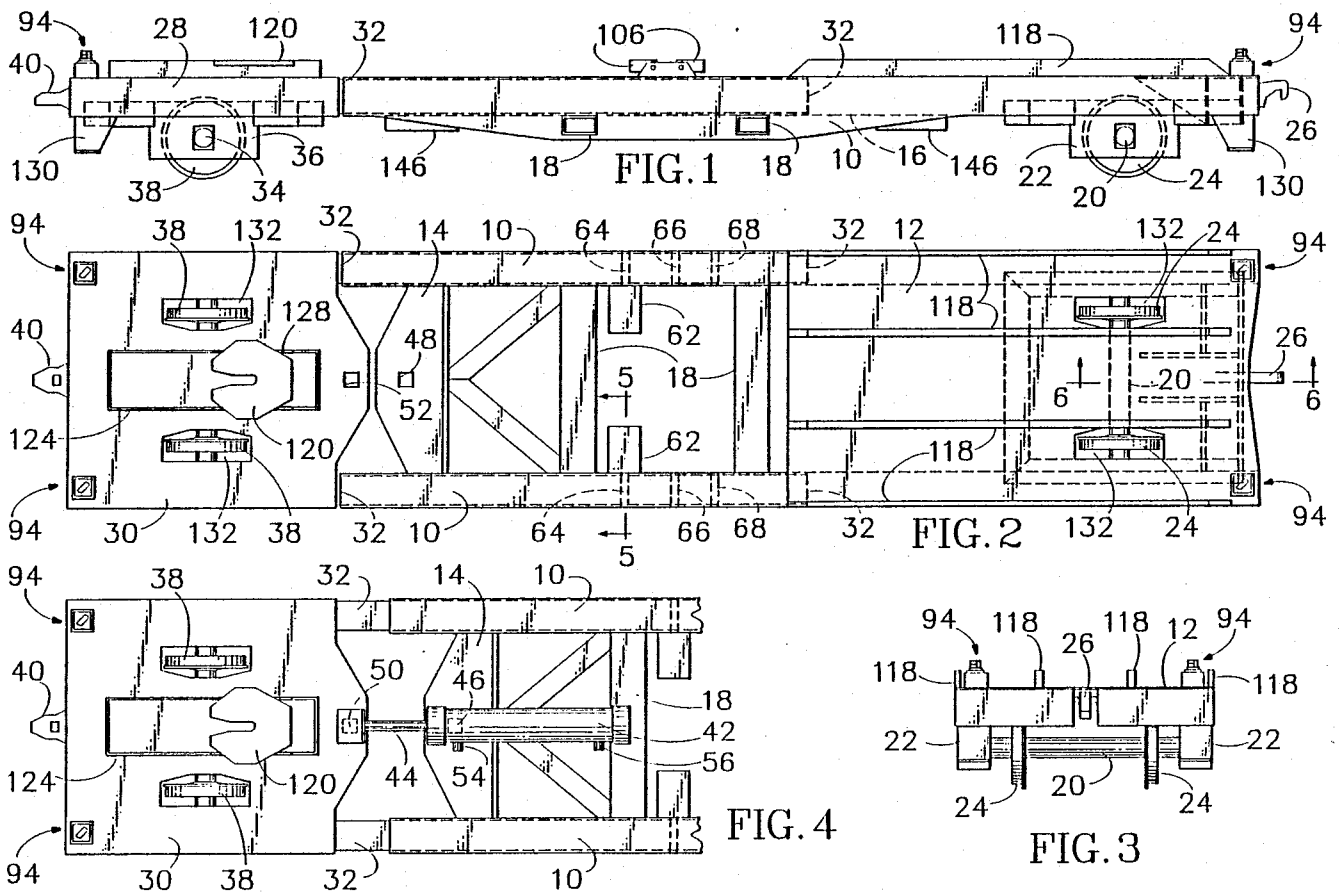
FIG. 1 is a side elevation of a rail car embodying the features of this invention.
FIG. 2 is a plan view as viewed from the top in FIG. 1.
FIG. 3 is an end view as viewed from the right in FIG. 1.
FIG. 4 is a fragmentary plan view showing the left end portion of the rail car of FIG. 2 in an extended position.

Referring primarily to FIGS. 1 and 2 of the drawings, the rail car is formed in two longitudinal sections for adjustment of overall length. One of the longitudinal sections includes laterally spaced elongated box beams 10 secured together by an interconnecting top bed plate 12 which extends from one end of the rail car to substantially the midpoint of the longitudinal section. The box beams 10 also are secured together by the transversely extending top bed plate 14 adjacent the end of the frame section opposite the bed plate 12.

Extending longitudinally through the widened intermediate portion of each box beam is a plate 16 which forms with the upper portions of the box beams an elongated opening of rectangular cross-section. These elongated openings serve a function described hereinafter.

The box beams 10 also are supported in spaced apart position by means of a pair of transversely extending box beams 18 which are spaced apart longitudinally and extend through the box beams 10 for the reception of the forks of a lift truck, for the purpose explained more fully hereinafter.

Underlying the bed plate 12 adjacent the corresponding end of the rail car frame section is a transverse axle 20 supported for rotation in bearings mounted in bearing housings 22 on resilient supports such as coil or leaf springs, air bags, rubber doughnuts, or other suitable suspension systems. Each bearing housing is secured to the under side of the corresponding box beam 10. The transverse axle mounts rail wheels 24 at its opposite end. A rail car coupling component, for example the male coupling component 26 illustrated, extends longitudinally outward of the end of the rail car frame section adjacent the rail wheels 24, on the longitudinal center line of the frame section.

Figure 5:
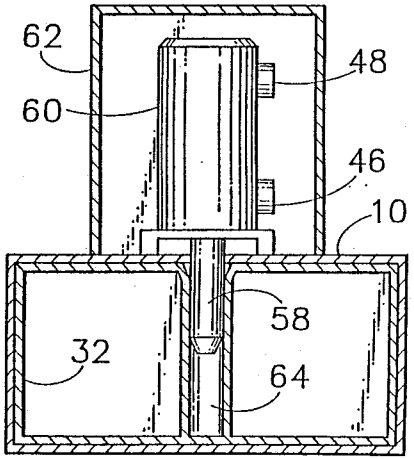
FIG. 5 is a sectional view taken on the line 5—5 in FIG. 2.

The second rail car frame section also includes a pair of laterally spaced box beams 28 secured in spaced apart position by the interconnecting top bed plate 30. A pair of elongated box beams 32 of smaller dimensions are secured to the box beams 28 and extend a substantial distance longitudinally therefrom for telescopic sliding reception within the rectangular openings formed in the box beams 10, as previously described and as best shown in FIG. 5. A transverse axle 34 is supported resiliently by bearings in bearing housings 36 secured to and extending downwardly from the box beams 28. The transverse axle mounts rail wheels 38 at its opposite ends.

A rail car coupling component, for example the female coupling component 40 illustrated, is secured to the top bed plate 30 and extends longitudinally outward therefrom on the longitudinal center line on the frame section. As will be understood, the female coupling component 40 and the male coupling component 26 are configured for releasable interconnection, for the coupling together of a plurality of rail cars to form a train.

The pair of rail car frame sections described hereinbefore are adjustable longitudinally one relative to the other, to vary the length of the rail car. This adjustability is afforded, in the embodiment illustrated, by a fluid pressure piston-cylinder unit (FIG. 4) the cylinder 42 of which is provided with a longitudinally extensible piston rod 44. An anchor post 46 on the cylinder 42 is configured to fit within an anchor post socket 48 provided in the top bed plate 14. In similar manner, an anchor post 50 on the piston rod is configured to fit in an anchor post socket 52 provided in the bed plate 30. The end of the cylinder 42 opposite the piston rod 44 rests freely upon the underlying transverse box beam 18, for supporting the end of the cylinder for limited lateral movement, to relieve side strain on the piston rod 44.

Use of the fluid pressure piston-cylinder unit to change the length of the rail car may be made either when the rail car is isolated from other rail cars, or when the rail car is integrated into a train. Hydraulic or pneumatic fluid pressure selectively to the cylinder couplings 54 and 56 is supplied from a service vehicle located at the site where the rail cars are stationed preparatory to use in a train. Quick-connect fittings preferably are utilized to facilitate this operation.

Positions of longitudinal extension of the frame sections of the rail car are secured by means of a locking pin 58 formed by the piston rod of a locking pin hydraulic cylinder 60 contained within a housing 62 secured to the inner side of each of the box beams 10. The piston rod 58 extends through an opening in the box beam 10 for a retractable extension into a selected one of a plurality of sockets formed at longitudinally spaced intervals in the telescoping box beams 32. Thus (FIG. 2), the sockets 64 are located to define the 40 foot overall length of the rail car; the sockets 66 are located to define the 45 foot length of the rail car; and the sockets 68 are located to define the 48 foot length of the rail car.

These sockets are illustrated in FIG. 2, with the locking pins 58 extended into the sockets 64 to establish the 40 foot length of the rail car. In FIG. 4 the frame sections are spaced further apart, by operation of the piston-cylinder unit, and the locking pins 58 are entered in the sockets 66 to establish the 45 foot length of the rail car.

As with hydraulic cylinder 42, cylinder 60 is supplied with fluid pressure from the service vehicle. This separate source of fluid pressure insures against accidental or other re-adjustment, mmid-adjustment, or disconnection of the sections of the rail car.

Figure 7:
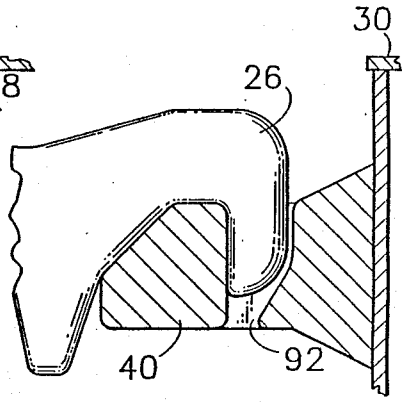
FIG. 7 is a fragmentary sectional view showing the male coupling component of FIG. 6 coupled to the female coupling component of an adjacent rail car.
Figure 6:
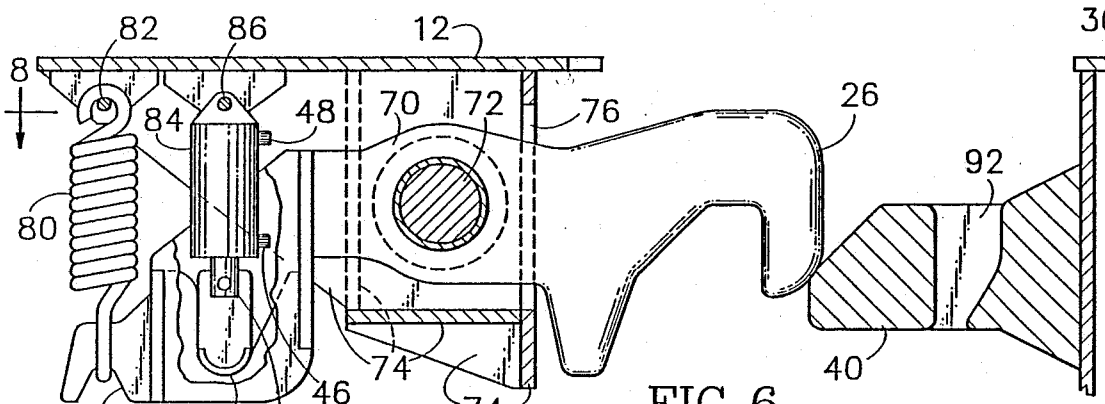
FIG. 6 is a sectional view taken on the line 6-6 in FIG. 2, showing the male coupling component in position preliminary to coupling to the female coupling component of an adjacent rail car.
Figure 8:
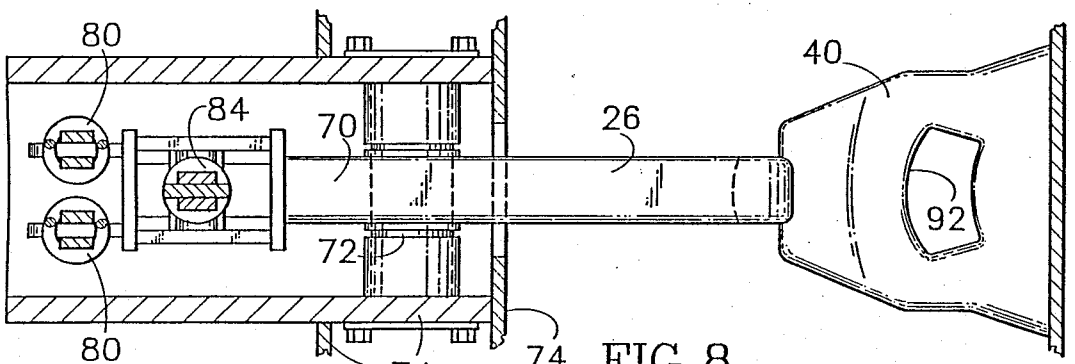
FIG. 8 is a fragmentary sectional view taken on the line 8—8 in FIG. 6.

Referring now to FIGS. 6, 7 and 8, the male coupling component 26 is shown to be integrated with a male coupling body 70 supported intermediate its ends by a pivot shaft 72 journalled in a support framework 74 secured to the underside of the top bed plate 12. The outer end of the coupling body 70 extends through an opening 76 in the support framework and the male coupling component 26 is formed as an integral part thereof.

The portion of the male coupling body 70 extending inwardly from the pivot shaft 72 is bifurcated and formed with anchor notches 78 for securing thereto one end of a pair of elongated coil closure springs 80. The opposite ends of the closure springs are secured to anchors 82 on the support framework 74. The closure springs 80 function to urge the coupling body 70 resiliently in the clockwise direction of rotation illustrated in FIG. 6, whereby to urge the male coupling component 26 resiliently to its closed position of engagement with the female coupling component 40 (FIG. 7).

The male coupling component 26 is moved to the open or uncoupled condition by counterclockwise rotation of the coupling body 70 about the pivot shaft 72, by operation of a coupler opener fluid pressure piston-cylinder unit. The cylinder 84 of the unit is supported by the framework 74 on pivot 86. The piston rod 88 of the unit is seated in an anchor saddle 90 formed on the inner portion of the coupling body 70. Thus, by applying fluid pressure in the cylinder to extend the piston rod 88, the coupling body 70 is rotated counterclockwise about the axis of its pivot shaft 72, to move the male coupling component 26 upwardly and out of engagement with the female coupling component 40.

As with cylinders 42 and 60, fluid pressure for cylinder 84 is supplied by the service vehicle to insure against accidental or surreptitious uncoupling of rail cars. Moreover, the remote operation of the cylinder 84 avoids the necessity of providing sufficient space between coupled rail cars for personnel ordinarily required to operate manual couplers. Accordingly, the coupler of this invention may be quite short, allowing the space between rail cars to be reduced to a minimum, for example about two feet. This reduces materially the air drag or wind resistance which contributes to excessive consumption of locomotive fuel.

As best illustrated in FIG. 8, the female coupling component 40 is provided with a laterally arcuate opening 92 for the removable reception of the male component 26 while allowing a limited degree of angular displacement between the coupling components, to accommodate travel of the rail cars in a train about curves in the road bed.

Figure 10:
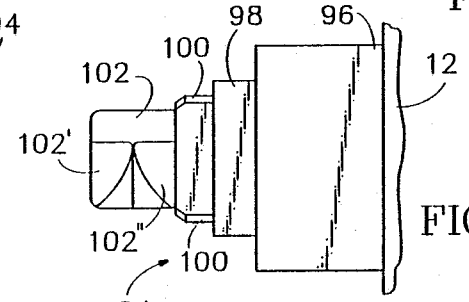
FIG. 10 is a fragmentary side elevation as viewed from the right in FIG. 9.
Figure 9:
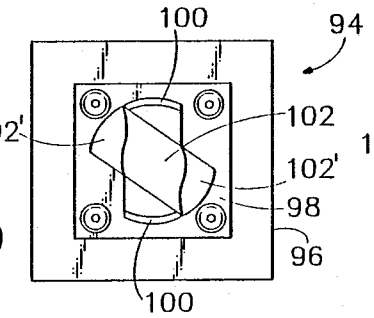
FIG. 9 is a plan view of a cargo container lock component incorporated in the rail car of FIG. 1.

Means is provided for securing cargo containers releasably to the rail car for transport. In the embodiment illustrated, such means is provided by twist locks 94 located at each of the four corners of the rail car, the locks being secured to the top bed plates 12 and 30. As illustrated in FIGS. 9 and 10, each twist lock is mounted upon a pedestal 96 to elevate it sufficiently above the ped plates to clear the bottom of a cargo container above other components of the rail car, to be described hereinafter. The twist lock includes a housing 98 extending from a pedestal 96 which is secured to the appropriate bed plate. The housing supports a pair of spaced, arcuate index plates 100 for registration with a rectangular opening in the bottom of a cargo container. The housing also mounts a rotor 102 for rotation through an arc of about 45°, relative to the index plates, against the resistance of a coil spring (not shown) contained within the housing.

As is well known, the index plates 100 align with a rectangular opening in the bottom of a cargo container and the rotor registers with the opening such that as the container is lowered onto the rotor, the weight of the container bearing down on the rotor causes an edge of the rectangular opening to engage an outer angled sections 102' of the rotor and thereby cause it to rotate through the arc of about 45° until it is in alignment with the rectangular opening, thereby allowing the container to be lowered further onto the lock. As the index plates and projecting portion of the rotor passes through the rectangular opening in the container, the coil spring within the housing urges the rotor in the opposite direction of rotation to return the rotor to the position illustrated in FIG. 9 where it locks the cargo container agianst upward displacement.

The rotor also is provided with inner angled sections 102" for engagement by an edge of the rectangular opening as the cargo container is lifted upwardly or away from the rail car. The rotor thus is caused to be rotated into alignment with the rectangular opening, allowing the container to be separated from the rail car.

Figure 11:
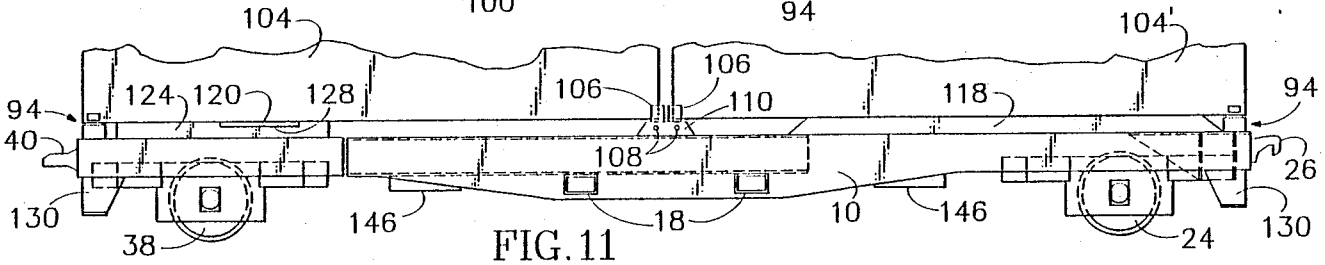
FIG. 11 is a side elevation showing the rail car of FIG. 1 mounting two 20 foot cargo containers.

FIG. 11 shows the rail car of this invention adjusted to the 40 foot length and arranged to support two 20 foot long cargo containers 104 and 104'. For this purpose there is provided on each side of the rail car intermediate the ends of the latter a pair of inner support blocks 106 each of which is supported by a pivot 108 between a pair of longitudinally extending support plates 110. Each support block is provided with an outer wall and an end wall for confining a corner of the inner end of the cargo container against lateral and longitudinal displacement. The outer ends of the 20 foot cargo containers are secured by the twist locks 94 previously described.

Figures 12, 13, 14:
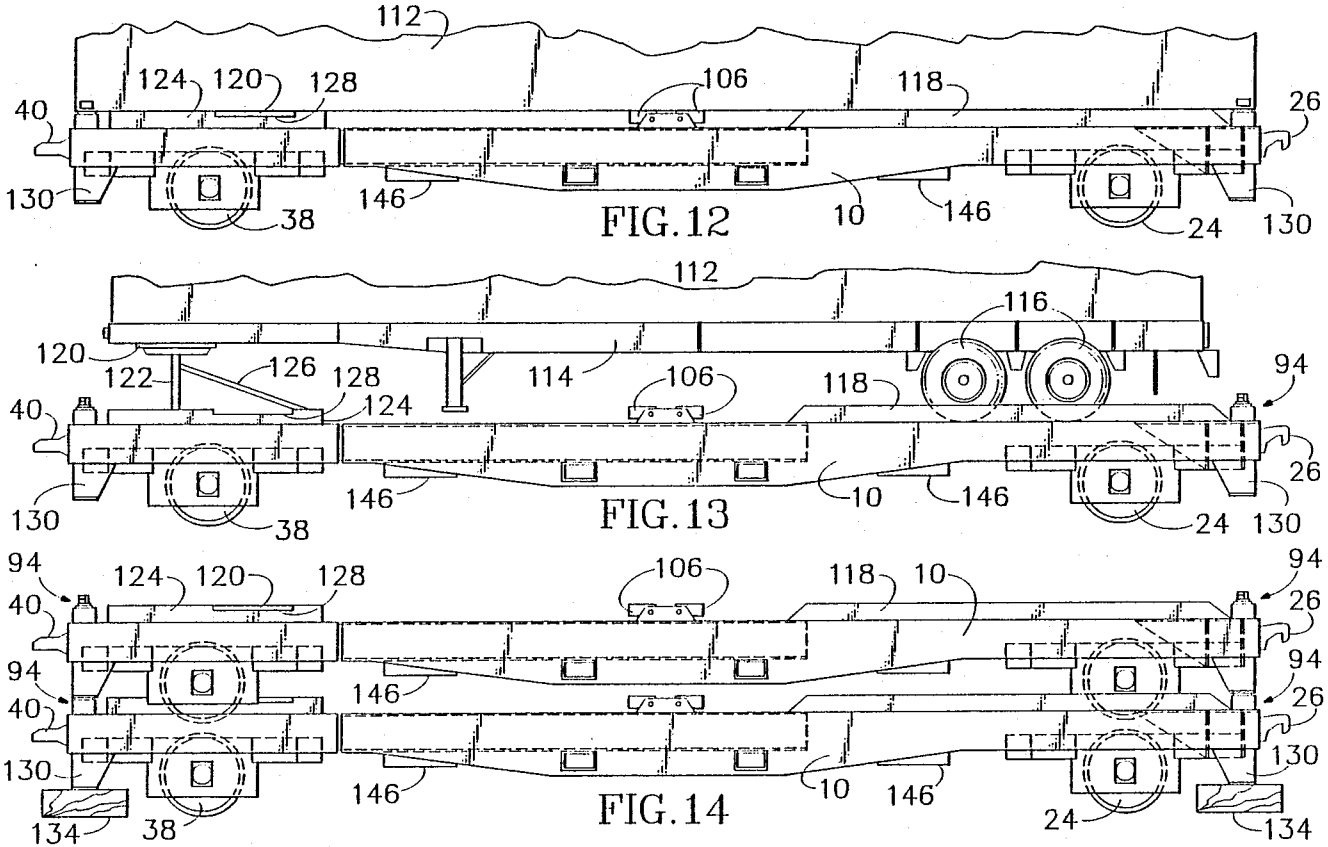
FIG. 12 is a side elevation showing the rail car of FIG. 1 mounting one 40 foot cargo container.
FIG. 13 is a side elevation showing the rail car of FIG. 1 supporting a semi-trailer provided with a 40 foot cargo container.
FIG. 14 is a side elevation showing the rail car of FIG. 1 supporting a second rail car atop it, for storage.

In FIG. 12, the 40 foot long rail car is adapted to support a single 40 foot long cargo container 112. For this purpose the inner support blocks 106 are swung downward about their pivots 108 so that the previously upstanding walls thereof lie horizontally below the plane of the support level of the corner twist locks 94. The inner support blocks thus are spaced below and out of interference with the bottom side of the 40 foot long cargo container.

FIG. 13 shows the 40 foot long rail car adapted for supporting the 40 foot long cargo container 112 of FIG. 12 as an integral component of a conventional semi-trailer 114 which includes rear wheels 116. When mounted on the rail car, the wheels 116 are contained in wheel guides formed by laterally spaced pairs of laterally spaced guide plates 118 (FIG. 2). The front end of the semi-trailer mounts a conventional king pin (not shown) configured to be secured releasably to a conventional fifth wheel 120 normally carried by the pulling tractor of a trailer assembly. In the embodiment illustrated, the fifth wheel is mounted on the outer end of an arm 122 which is secured pivotally at its lower end to the base of a rectangular housing 124 secured to the bed plate 30. A brace 126, also secured pivotally at one end of the housing 124, is arranged at its opposite end for releasable connection to the arm 122, to secure the latter in upstanding position at which the fifth wheel is disposed for supporting the king pin of a trailer.

As is well known, release of the brace 126 from engagement with the arm 122 results in the arm swinging downward and rearward into the housing 124, to collapse the fifth wheel 120 into the housing to a position below the corner twist lock housings 98. For this purpose the side walls of the housing 124 are provided with notches 128 in which to receive the laterally projecting side portions of the fifth wheel 120.

In accordance with this invention, means is provided for securing two or more of the rail cars together, one upon another, for transport or storage. In the embodiment illustrated, rail car support pedestals 130 are provided at the four corners of the rail car on the underside of the latter and in vertical alignment with the four corner twist locks 94. Each corner pedestal is provided with a bottom wall containing a rectangular opening adapted to receive the rotor 102 of the twist lock, in the manner previously described in connection with the attachment of a cargo container.

Thus, referring to FIG. 14, a second rail car may be mounted atop a lower rail car in such a manner that the corner pedestals 130 register with the corner twist locks 94 to secure the upper rail car against lateral and longitudinal displacement relative to the underlying support car. Rail car wheel openings 132 are provided in the bed plates 12 and 30 to receive the rail wheels 24 and 38 of the rail car above.

FIG. 14 illustrates the vertical standing of horizontally disposed rail cars one upon another for stationary storage at a location away from railroad tracks. For this purpose support blocks 134 are mounted upon the ground at the four corners of the rail car corner pedestals 130. The lowermost rail car thus is supported on the support blocks with the rail wheels 24 and 38 elevated above ground.

In the alternative, stationary storage of a vertical stack of rail cars may be provided with the bottommost rail car supported on railroad tracks, such as a siding in a rail yard. In either instance of stationary support, a vertical stack of eight or more rail cars is entirely feasible with presently available heavy lifting equipment discussed hereinafter.

On the other hand, a vertical stack of three or four horizontally disposed rail cars may be provided, with the bottommost rail car integrated into a train for transport to a distant location. This arrangement affords the advantage of shortening the train by the distance ordinarily occupied by the number of rail cars stacked upon and supported by the lowermost rail car in the stack.

Figure 15:
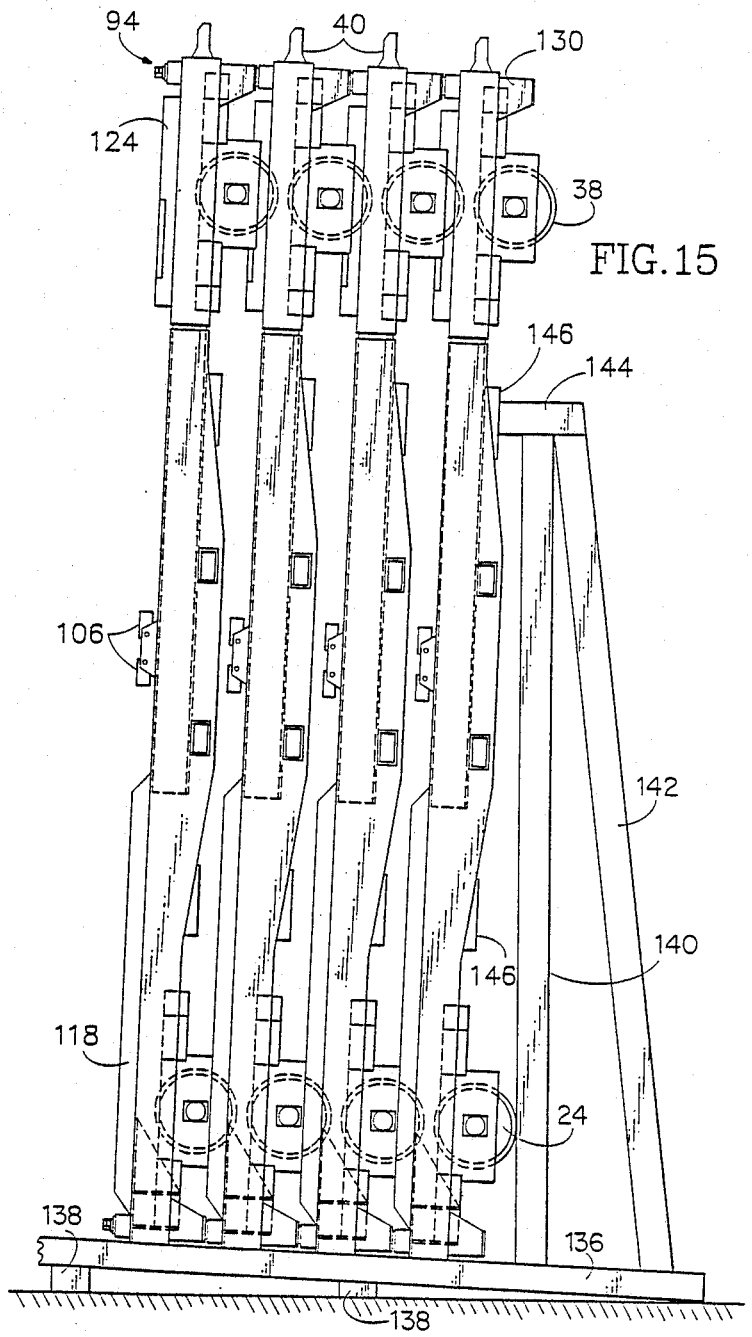
FIG. 15 is a side elevation showing a plurality of the rail cars of FIG. 1 disposed in substantially vertical position for storage.

A plurality of the rail cars of this invention may also be stored in a substantially vertical position. Referring to FIG. 15 of the drawings, a storage rack for the rail cars is shown to include an angled base 136 supported upon the ground at a slight angle relative to horizontal, by such means as the support posts 138. The angled base supports a plurality of vertically extending frame members 140 and reinforcing angle beams 142. Across the top of the frame members and beams is a horizontal abutment beam 144 against which a first rail car may be rested in a substantially vertical position, with its lower end resting upon the angled base 136.

It is to be noted in FIG. 15 that a plurality of the rail cars may be supported in substantially vertically extending position with one rail car resting against another, preferably with the corner pedestals 130 engaging the corner twist locks 94.

Alternative means preferably are provided on the rail car for lifting and manipulating it to the horizontally stacked arrangement illustrated in FIG. 14 or the vertical stacked arrangement illustrated in FIG. 15. Thus, as previously mentioned, the transverse box beams 18 are not only secured to the laterally spaced longitudinal box beams 10, but they also extend through the box beams 10 to provide a pair of openings at both lateral sides of the rail car, for the reception of the forks of a heavy duty lift truck. The lift truck thus may pick up the rail car and transport it to a site of storage, such as the off-truck storage position illustrated in FIG. 14 in which a plurality of the rail cars are stacked one upon another in horizontally extending condition, or to the rack shown in FIG. 15 for storing a plurality of the rail cars in substantially vertical condition. For this latter purpose, it is understood that the type of lift truck utilized requires that the lift truck carriage which supports the forks must also be capable of rotation about a substantially horizontal axis, in order for the forks to be rotated to a substantially vertical plane.

In the alternative, the rail car is provided with a pair of longitudinally spaced lifting pads 146 for abutment of a pair of spaced bottom foot clamps of a conventional piggy-packer type lift machine capable of lifting rail cars for the arrangement of FIG. 14.

As a further alternative, the twist locks 94 may be utilized with a conventional cargo container type lifter to lift the rail cars of this invention for horizontal stacking for storage of transport.

Figure 16:
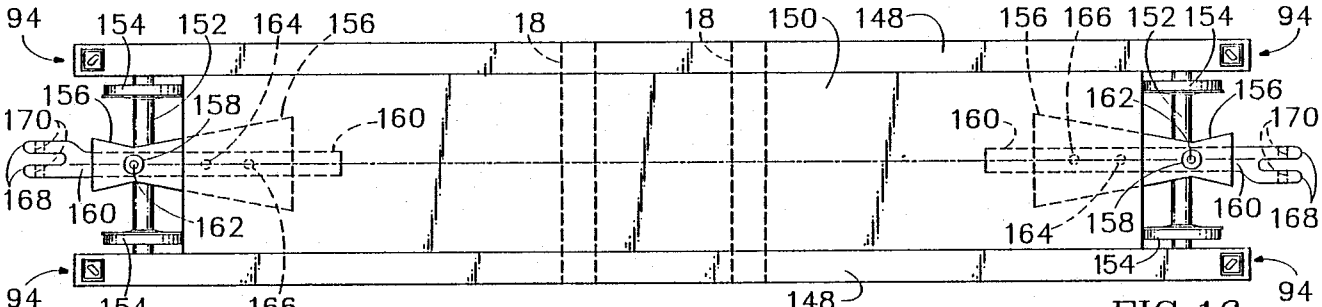
FIG. 16 is a plan view of a second embodiment of a rail car of this invention.

FIG. 16 illustrates an alternative construction by which the rail car of this invention may be adjusted in overall length, i.e. the distance between the coupling components 26 and 40. Thus, whereas in the embodiment first illustrated this distance is varied by the longitudinal adjustment of two frame sections, the embodiment illustrated in FIG. 16 provides a rail car frame of fixed length supporting a longitudinally adjustable coupling-mounting tongue at one or both ends. Thus, the rail car is provided with a pair of laterally spaced longitudinally extending side box beams 148 secured together is spaced apart condition by means of the interconnecting top bed plate 150. The side box beams support a pair of transversely extending axles 152 adjacent the opposite ends of the frame, with each axle mounting laterally spaced rail wheels 154.

In the preferred embodiment illustrated, an elongated hollow tongue guide sleeve 156 is secured to the underside of the bed plate 150 adjacent each of the opposite ends of welding. Each sleeve flares longitudinally outward and inward from an intermediate point which mounts a hollow vertical bearing 158. An elongated tongue 160 extends slidably through each guide sleeve for longitudinal adjustment in the longitudinal direction of the rail car frame.

The desired longitudinal adjustment of the tongue is secured by retractably extending a locking pin 162 through the hollow bearing 158 and into any one of a plurality of sockets provided at longitudinally spaced intervals in the tongue. For example, the locking pin and socket arrangement may be provided in the manner of the piston-cylinder unit and associated sockets illustrated in FIG. 5.

In FIG. 16, it is to be noted that the locking pin 162 extends through the hollow bearing 158 and into a socket in the tongue which adjusts the overall length of the rail car to 40 feet. The sockets 164 and 166 afford adjustment of the overall length of the rail car to 45 feet and 48 feet, respectively.

Although the coupling components provided at the outer ends of the tongues 160 may take the form of the male and female coupling components illustrated in FIGS. 6, 7 and 8, or any other conventional form of coupling assembly desired, the coupling illustrated in FIG. 16 comprises a laterally bifurcated member forming a pair of laterally spaced outwardly projecting fingers 168. The fingers are configured so that they interlace with the fingers of another couling on the confronting end of an adjacent rail car. The fingers are provided with axially aligned, registering openings 170 which extend on a substantially horizontal axis and are configured to removably receive a coupling pion. The coupling pin thus serves to couple together an interlaced pair of the bifurcated couplings to interconnect adjacent rail cars together. The coupling pin allows articulation of the coupling fingers about a substantially horizontal axis, to accomodate vertical variations in a railroad bed. The outwardly and inwardly flared guide sleeves 156 allow the tongues 160 to pivot about the vertical axes of the locking pins 162 to permit articulation of the rail cars around curves.

It will be apparent to those skilled in the art that various changes may be made in the size, shape, type, number and arrangement of parts described hereinbefore. For example, the special car coupling components 26 and 40 may be replaced with conventional or other forms of couling components. One rail car of this invention may be provided at one end with a conventional coupling commponent in order for the rail car to be coupled to a locomotive or to the last conventional rail car of a train. The automatic twist locks 94 may be replaced with manual twist locks or other suitable locking mechanism. The single axle and wheel assemblies may be replaced with dual systems. These and other changes may be made, as desired, without departing from the spirit of this invention and the scope of the appended claims.

Having now described my invention and the manner in which it may be used, I claim:

1. A rail car for carrying cargo containers, comprising:
(a) an elongated wheeled frame comprising opposite end sections secured together for longitudinal adjustment of length for mounting cargo containers of diverse lengths,
(b) coupling means at the opposite ends of the frame sections for connecting a plurality of said frames together to form a train, and
(c) securing means on the opposite end sections of the frame for releasably securing a cargo container to the frame.

2. The cargo container of claim 1 wherein each opposite end section includes supporting rail wheels, whereby the distance between the longitudinally spaced wheels changes with adjustment of the opposite end sections of the frame.

3. The rail car of claim 1 including extensible power means interengaging the opposite end sections and operable to move said sections toward and away from each other.

4. The rail car of claim 1 including locking means releasably enterengaging the opposite end sections for securing said sections together releasably in selected positions of longitudinal adjustment.

5. A rail car for carrying cargo containers, comprising:
(a) an elongated wheeled frame
(b) coupling means at the opposite ends of the frame for connecting a plurality of said frames together to form a train, and
(c) means on the frame for securing at least two of said wheeled frames together, one upon another, against relative lateral and longitudinal displacement, for storage or transport.

6. The rail car of claim 5 wherein the securing means comprises releasably interengageable lock means adjacent each corner of the frame extending upwardly and downwardly therefrom in vertical alignment.

7. A rail car for carrying cargo containers, comprising:
(a) an elongated wheeled frame comprising opposite end sections secured together for longitudinal adjustment of length for mounting cargo containers of diverse lengths,
(b) extensible power means interengaging the opposite end sections and operable to move said sections toward and away from each other, said extensible power means comprising a fluid pressure piston-cylinder unit, and connector means on the cylinder of said unit for coupling thereto a source of fluid pressure,
(c) coupling means at the opposite ends of the frame sections for connecting a plurality of said frames together to form a train, and
(d) securing means on the opposite end sections of the frame for releasably securing a cargo container to the frame.

8. The frame car of claim 7 wherein said connector means is configured for coupling a source of fluid pressure remote from the rail car.

9. A rail car for carrying cargo containers, comprising:
(a) an elongated wheeled frame,
(b) coupling means at the opposite ends of the frame for connecting a plurality of said frames together to form a train,
(c) the elongated wheeled frame including an elongated tongue member mounted on said least one end of the frame and supporting an associated one of the coupling means, the tongue means being mounted for longitudinal adjustment relative to the frame for adjusting the distance between the coupling means at the opposite ends of the frame, and
(d) securing means on the frame for releasably securing a cargo container to the frame.

10. The rail car of claim 9 including locking means releasably enterengaging the frame and tongue member for securing said tongue member releasably in selected positions of longitudinal adjustment.

11. The rail car of claim 9 wherein the elongated wheeled frame includes an elongated tongue member mounted at each longitudinal end of the frame and each supporting one of the coupling means and each being mounted for longitudinal adjustment relative to the frame for adjusting the distance between the coupling means at the opposite ends of the frame.

12. The rail car of claim 11 including locking means releasably enterengaging the frame and each tongue member for securing said tongue member releasably in selected positions of longitudinal adjustment.

13. A rail car for carrying cargo containers, comprising:
(a) an elongated wheeled frame,
(b) coupling means at the opposite ends of the frame for connecting a plurality of said frames together to form a train,
(c) securing means on the frame for releasably securing a cargo container to the frame, and
(d) releasably interengagable lock means adjacent each corner of the frame extending upwardly and downwardly therefrom in vertical alignment, for securing a plurality of said frames one upon another for transport or storage.

14. The rail car of claim 13 wherein said releasably interengagable lock means comprises a rotary component and a fixed component configured to interengage upon the application of a force exerted upon one of said components in the direction toward the other component sufficient to effect rotation of the rotary component into locking engagement with the other component.

15. The rail car of claim 14 wherein the components of said lock means are also configured to disengage from each other upon the application of a force exerted upon one of said components in the direction away from the other component sufficient to effect rotation of the rotary component into disengagement with the other component.

16. A rail car for carrying cargo containers, comprising:
(a) an elongated wheeled frame,
(b) coupling means at the opposite ends of the frame for connecting a plurality of said frames together to form a train,
(c) means on the frames for adjusting the distance between said coupling means, and
(d) securing means on the frame for releasably securing a cargo container to the frame, the securing means including lock mens adjacent each corner of the frame extending upwardly therefrom for releasably engaging the corresponding corners of a cargo container, and a fifth wheel mounted on the frame for adjustment between an operative position elevated above the frame for releasably engaging the king pin of a semi-trailer, and a retracted position adjacent the frame below the operative height of the corner lock means.

17. A rail car for carrying cargo containers, comprising:

(a) an elongated wheeled frame, (b) coupling means at the opposite ends of the frame for connecting a plurality of said frames together to form a train, (c) means on the frame for adjusting the distance between said coupling means, and (d) securing means on the frame for releasably securing a cargo container to the frame, the securing means including lock means adjacent each corner of the frame extending upwardly thereform for releasably engaging the corresponding corners of a cargo container, and a pair of support members mounted centrally adjacent the opposite sides of the frame for adjustment between an operative position elevated above the frame for supporting the inner ends of a pair of cargo containers the outer ends of which are engaged with the corner lock means, and a retracted position adjacent the frame below the oerative height of the corner lock means.

18. The rail car of claim 17 wherein the securing means includes a fifth wheel mounted on the frame for adjustment between a retracted position adjacent the frame below the operative height of the corner lock means and an operative position elevated above the frame for releasably engaging the king pin of a semi-trailer.

19. A rail car for carrying cargo containers, comprising:

(a) an elongated wheeled frame, (b) coupling means at the opposite ends of the frame for connecting a plurality of said frames together to form a train, (c) means on the frame for adjusting the distance between said coupling means, and (d) securing means on the frame for releasably securing a cargo container to the frame, the securing means including a fifth wheel mounted on the frame for adjustment between a retracted position adjacent the frame and an operative position elevated above the frame for releasably engaging the king pin of a semi-trailer.

20. The rail car of claim 19 wherein the securing means includes upstanding side plates on the frame adjacent the opposite sides thereof adjacent the end opposite the fifth wheel, for confining between said side plates the wheels of a semi-trailer.

21. A rail car for carrying cargo containers, comprising:

(a) an elongated wheeled frame, (b) coupling means at the opposite ends of the frame for connecting a plurality of said frames together to form a train, the coupling means comprising a first coupling body mounted pivotally intermediate its end on one end of the frame for pivotal movement about a substantially horizontal transverse axis, said body extending in the longitudinal direction of the frame and having inner and outer ends, the outer end having a first coupler component thereon, resilient means interengaging the inner end portion of the body and the frame for urging the coupler component to coupling condition, power means interengaging the inner end portion of the body and the frame for moving the coupling component to uncoupling condition, a second coupling body mounted on the opposite end of the frame and extending longitudinally outward therefrom, and a second coupler component on the outer end of said second coupler body configured for releasable engagement of the first coupler component on an adjacent rail car frame, and (c) securing means on the frame for releasably securing a cargo container to the frame.

22. The rail car of claim 21 wherein the first coupler component is a hook component and the second coupler component is a laterally arcuate opening in the second coupling body.

23. A rail car for carrying cargo containers, comprising:

(a) an elongated wheeled frame, (b) coupling means at the opposite ends of the frame for connecting a plurality of said frames together to form a train, the coupling means comprising a pair of bifurcated members mounted one on each of the opposite ends of the frame, each bifurcated member forming a pair of laterally spaced fingers configured to interlace with a like pair of fingers of another bifurcated coupling means on an end of another rail car frame, the bifurcated fingers having openings therethrough aligned on a substantially horizontal axis for the removable reception of a connecting member for detachably coupling together an interlaced pair of bifurcated members, and (c) securing means on the frame for releasably securing a cargo container to the frame.

24. A rail car for carrying cargo containers, comprising:

(a) an elongated wheeled frame, (b) coupling means at the opposite ends of the frame for connecting a plurality of said frames together to form a train, (c) securing means on the frame for releasably securing a cargo container to the frame, and (d) lift-engaging means on the frame for engagement by lifting mechanism for raising the frame vertically for stacking it in substantially horizontal disposition upon another of said frames or in substantially vertical disposition against a support.

25. The rail car of claim 24 wherein the lift-engaging means comprises a pair of laterally spaced fork-receiving openings for removably receiving therein the spaced forks of a fork lift.

26. The rail car of claim 24 wherein the lift-engaging means comprises a pair of laterally spaced lift pads for engagement by a piggy-packer type lift machine.

27. The rail car of claim 24 wherein the lift-engaging means comprises twist locks adjacent the corners of the rail car frame arranged for releasable engagement by a cargo container top lifter.

* * * * *